US011655132B2

(12) United States Patent
Poeschl

(10) Patent No.: US 11,655,132 B2
(45) Date of Patent: May 23, 2023

(54) APPARATUS FOR FILLING A CONTAINER WITH A FILLING PRODUCT

(71) Applicant: KRONES AG, Neutraubling (DE)

(72) Inventor: Stefan Poeschl, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 17/126,875

(22) Filed: Dec. 18, 2020

(65) Prior Publication Data

US 2021/0188610 A1 Jun. 24, 2021

(30) Foreign Application Priority Data

Dec. 19, 2019 (DE) ..... 10 2019 135 257.6

(51) Int. Cl.

| | |
|---|---|
| ***B67C 3/06*** | (2006.01) |
| ***B67C 3/20*** | (2006.01) |
| ***B67C 3/22*** | (2006.01) |
| ***B67C 7/00*** | (2006.01) |
| ***B67C 3/26*** | (2006.01) |

(52) U.S. Cl.

CPC ..... *B67C 3/06* (2013.01); *B67C 3/208* (2013.01); *B67C 3/225* (2013.01); *B67C 3/2617* (2013.01); *B67C 7/004* (2013.01); *B67C 2007/006* (2013.01); *B67C 2007/0066* (2013.01)

(58) Field of Classification Search

CPC ..... B67C 3/023; B67C 3/06; B67C 3/208; B67C 3/225; B67C 3/26; B67C 3/2617; B67C 7/004; B67C 2007/006; B67C 2007/0066

USPC ..... 53/167, 267, 281, 471

See application file for complete search history.

(56) References Cited

U.S. PATENT DOCUMENTS

| | | | | |
|---|---|---|---|---|
| 2008/0271809 | A1 | 11/2008 | Goldman et al. | |
| 2009/0236007 | A1* | 9/2009 | Clusserath | B65B 3/26 141/198 |
| 2010/0223891 | A1* | 9/2010 | Knott | B67C 3/22 53/507 |
| 2011/0039044 | A1* | 2/2011 | Clusserath | B67C 3/208 141/94 |
| 2011/0303325 | A1* | 12/2011 | Gras | B67C 3/007 141/105 |
| 2019/0106311 | A1* | 4/2019 | Habersetzer | B67C 3/10 |
| 2020/0198954 | A1* | 6/2020 | Angerer | B67C 3/26 |

FOREIGN PATENT DOCUMENTS

| | | | |
|---|---|---|---|
| DE | 102007031961 | 1/2009 | |
| DE | 10 2009 049 583 A1 | 5/2011 | |
| DE | 102017119069 | 2/2019 | |
| DE | 102017119069 A1 * | 2/2019 | B67C 3/26 |

(Continued)

OTHER PUBLICATIONS

Extended European Search Report dated Apr. 30, 2021, European Patent Application 20215415.9, 7 pages.

*Primary Examiner* — Andrew M Tecco
*Assistant Examiner* — Jacob A Smith
(74) *Attorney, Agent, or Firm* — Haynes and Boone, LLP

(57) ABSTRACT

An apparatus for filling containers with a filling product, for example in a beverage bottling plant, includes a plurality of filling members, which respectively have a filling product line for feeding the filling products into an appropriate container; and at least one distribution line, to which the filling product lines of the plurality of filling members are linked.

20 Claims, 3 Drawing Sheets

(56) References Cited

FOREIGN PATENT DOCUMENTS

| | | | |
|---|---|---|---|
| EP | 0 775 668 | A1 | 5/1997 |
| EP | 0979797 | | 2/2000 |
| EP | 2 272 790 | A1 | 1/2011 |
| EP | 3473587 | | 4/2019 |
| WO | WO 2009/114121 | A1 | 9/2009 |
| WO | WO 2010/124766 | | 11/2010 |

* cited by examiner

APPARATUS FOR FILLING A CONTAINER WITH A FILLING PRODUCT

CROSS REFERENCE TO RELATED APPLICATIONS

This application claims priority from German Patent Application No. DE 10 2019 135 257.6 filed on Dec. 19, 2019 in the German Patent and Trademark Office, the disclosure of which is incorporated herein by reference in its entirety.

TECHNICAL FIELD

The present invention relates to an apparatus for filling containers with a filling product, for example beverages, such as beer, soft drinks, mixed beverages, juices or carbonated filling products.

RELATED ART

In order to mix and bottle filling products consisting of a plurality of components, various technologies for dosing the individual components are known, which are briefly presented below:

In the bottling of carbonic-acid-containing beverages, such as CSD products (CSD standing for "carbonated soft drinks"), it is known to produce the beverage in a mixer from syrup and water and to carbonate it in the mixer. The beverage is subsequently transported to filling members and filled by these homogeneously into containers. If frequent changes of product are made, a not inconsiderable product loss can arise, for instance in the pipelines from the mixer to the filling members. In addition, such plants for the bottling of small batches, for instance up to 10,000 bottles, are barely profitable. Bottling plants of this kind, despite measures for shortening changeover times, are not very flexible. It is, for instance, not readily possible, in a small batch, to fill half of the bottles with lemonade and the other half with orangeade.

In order to avoid the production of large product quantities in a mixer, the desired components are able to be individually dosed and bottled, for instance, via separate dosing stations, as is known, for instance, from US 2008/0271809 A1. The use of separate dosing stations for a multiplicity of components leads, however, to a complex plant structure and process flow, since the filling of each container is divided amongst a plurality of separate dosing/bottling stations, at which the container must be positioned for the respective dosing times. Although it is in principle possible to dose the plurality of components simultaneously into the containers via separate lines and dispensing openings at a common bottling station, this is limited, however, by the size of the bottle mouth or container mouth.

Alternatively, the bringing together of the components can be realized in a common filling valve, cf. for instance EP 0 775 668 A1 and WO 2009/114121 A1. The dosing of a component to be added to a base fluid is herein realized before the filling valve outlet, wherein the desired quantity can be measured off, for instance, by a volume measurement by means of a flowmeter (EP 0 775 668 A1), or by another volumetric dosing technology (WO 2009/114121 A1), for example by means of a dosing piston and/or a diaphragm pump.

High dosing accuracies are able to be attained by a measuring-out with the aid of a flowmeter. This measures the volume to be dosed or the mass to be dosed and, when a threshold value is reached, closes a shut-off valve in the dosage line. Other volumetric dosing methods, such as the use of pumps or time/pressure filling, often exhibit major uncertainties and tend to react more sensitively to changes in the dosage medium, for instance to changes in the pressure, temperature or composition. A frequent calibration, in particular upon a change of dosage medium, is the result. A gravimetric measurement of the dosages is barely feasible due to large differences between the dosage weight, in respect of very small quantities (μl), and the container weight.

The above-stated technologies are distinguished by the fact that the components are mixed together at a late stage, i.e. either during or shortly before the bottling. The late mixing is also, however, associated with technical difficulties. Thus, a temporal optimization of the bottling operation is not readily possible, since the dosing operation, for instance using a flowmeter, cannot be accelerated according to requirement. The time for which the container remains under the dosing point is directly proportional to the output of the bottling line. In the case of a higher output requirement, either the dosing time, and hence the dosing range, has to be reduced, or a second, parallel dosing line has to be constructed. The possible dosing range is dependent on the available dosing time, and hence on the line capacity.

Added to this is the fact that the late blending entails a not inconsiderable structural complexity. In the case of small container mouths, it is only with difficulty possible to fill a moving container with a fixed dosing head. Therefore, either the dosing head must move jointly with the container (for instance as a rotary unit) or the container must remain under the dosing head for the dosing and bottling operation, such as in the case of a linear transfer machine. If now a multiplicity of diverse dosage components is intended to be available at the same time, both solutions, due to the multiplicity of filling points and/or dosage components at the filling valve, are complex from a mechanical engineering standpoint, costly and maintenance-intensive and require a good deal of installation space.

Those dosage techniques which at the same time determine the volume and convey the medium, for example by means of pumps or piston-type dosers, have a drawback in that no feedback regarding the volume which has actually been fed into the container can be given to the control system. This applies equally to the time/pressure filling. Where a valve does not open or the line is blocked, this cannot readily be immediately recognized by the system. Since a subsequent quality control of the filled container in the case of an individualized filling with a plurality of components cannot be realized, or only very laboriously, a feedback from the dosage system regarding the quantity which has actually been dosed is desirable, if not absolutely necessary.

The above-described technical problems have led to a refinement of the dosing/bottling process, which refinement is evident, for instance, from EP 2 272 790 A1 and DE 10 2009 049 583 A1. In these, directly in the bottling operation, the components of the filling product are dosed by means of a flowmeter and fed jointly into the container to be filled, wherein, in the dosing operation, a main component of the added component is displaced rearwards. The displaced volume of the main component is determined by means of the flowmeter, and thus the volume of the added component is known and controllable. Upon the subsequent filling of the filling product into the container, the main component, together with the added component, is flushed fully out of the filling valve into the container, wherein, at the same time, the total fill quantity can be determined with the same flowmeter. In the next bottling cycle, the fill quantities, and also the added component quantities, can be redefined. A highly flexible bottling of individualized beverages is thus possible without changeover times.

When the variety is changed, it can happen that residues of a previous filling product, in particular any dosage components, remain behind in the filling valve. Aromatic substances, small pieces of fruit and the like can be entrained and contaminate following bottling operations. In order that, as far as possible, there remain in the filling valve no residues which could contaminate the filling product in the following filling operation, the quantity and bottling of the main component must be arranged such that the said main component completely frees the filling valve of residues of the previous bottling. The degree of cleaning is determined, inter alia, by how quickly and at what pressure the filling valve, in the dispensing of the filling product into the container, is flushed through. For a number of reasons, however, the flushing-through of the filling valve cannot be accelerated according to requirement. Thus, in the bottling of carbon-dioxide-containing beverages, frothing-over can easily occur. Equally, the displacement of the atmosphere present in the container inhibits, during the bottling, an acceleration of the bottling process.

A further difficulty in the flexible bottling through the dosing of components into the filling valve consists in the fact that the carbon dioxide content of the filling product cannot readily be flexibilized, i.e. cannot readily be adjusted on a container-wise and/or variety-wise basis. The main component of the filling product, for instance water, normally has a defined carbonic acid content. The dosage component, for instance fruit syrup, has a defined brix content. Carbonic acid content and brix content clearly define the mix ratio. For a variety of the filling product, the carbonic acid content of the main component can be adapted such that, after the mixing and bottling, the desired content is contained in the container. If always only one variety of the filling product is bottled on the filling machine, with the next variety the carbonic acid content of the main component can be adapted on a variety-specific basis. Should, however, two or more varieties be bottled directly one after another or at the same time through a plurality of interconnected filling valves, which is in principle possible by the individual addition of dosage components, the carbonic acid content of the bottled filling product can no longer be adjusted on a variety-specific basis, since this content is determined by the main component.

Added to this is a further difficulty, which consists in the fact that, as a result of the drainage of the atmosphere in the container, mostly air, during the filling operation, aromas can be entrained out of the product, via the return gas duct, into the product vessel. This too acts counter a variety-pure bottling (liquid-bound and gas-bound constituents) in the case of the container-wise change of variety.

For the feeding and measuring-off of main and/or dosage components into the filling member, this is connected to fluid lines which draw the respective component out of a reservoir and, for this purpose, are equipped with valves, flowmeters and the like. The structural complexity of the plant is considerable, in particular if this is equipped, for example as a rotary machine, with a multiplicity of filling members. Moreover, the complex, fluidic linkage of the filling members can make the handling and cleaning thereof more difficult and adversely affect the reliability.

SUMMARY

The present disclosure describes improvements in flexible bottling, in particular in enabling a container-wise or container-group-wise and/or variety-specific bottling, while reducing the structural complexity according to various embodiments.

The apparatus according to the invention serves to fill containers with a filling product. The filling product can be a multicomponent filling product consisting of at least two components, wherein one of the components, for the purposes of linguistic differentiation, is herein referred to as a "base liquid" or "main component". Any further components are referred to as "(a) dosage component(s)". Besides the bottling of the filling product, the apparatus, in the case of a plurality of components, is arranged to bring together and, where appropriate, at least partially mix the components and, in this respect, undertakes at least a part of the production process of the filling product to be bottled. The base liquid is, for instance, water (still or carbonated) or beer. The dosage component(s) can include syrup, fruit-flesh-containing liquids, pulp, aromas, etc. If the filling product consists only of a main component, without dosage component(s), then the terms "main component" and "filling product" are used synonymously. The apparatus is thus used, in a particular example, in a beverage bottling plant. Carbon dioxide, the addition of which, by virtue of the herein described filling process, is likewise possible, does not fall under the term "dosage component."

The apparatus has a plurality of filling members, which respectively have a filling product line for feeding the filling product into an appropriate container, i.e. one which is temporarily assigned, for bottling, to the filling member and is normally located under the filling member. The apparatus further has at least one distribution line, to which the filling product lines of the plurality of filling members are linked (in a fluid-conducting manner). The distribution line is thus arranged to feed a therein located fluid into the filling product lines of the plurality of filling members.

In other words, the filling product lines of the relevant filling members are not connected individually to one or more reservoir(s), but rather via a common connecting line. The filling product lines can branch off from the connecting line, or the connecting line can have a plurality of sections, which respectively, at their ends, open into the filling product lines of the filling members. Thus the filling product line of a filling member is initially, for instance, in fluidic connection with the filling product line of an adjacent filling member, whilst this, in turn, is generally in fluidic connection with the filling product line of the second neighbour, etc. The term "fluidic connection" means that a fluid can flow between the fluidically connected components. This does not preclude an interposition of components which can prevent the transport of fluid, such as valves.

A fluidic "serial connection" of this kind, which includes a typical "ring circuit", reduces the mechanical complexity of the apparatus. An individual linkage of the filling members to a base reservoir and/or to dosage reservoirs can be avoided, whereby fluid-carrying components, such as lines, valves and the like, can be waived. An improvement in the reliability and a reduction in the maintenance and cleaning effort of the apparatus thus go hand and in hand.

As already noted above, the filling product lines of the plurality of filling members generally branch off from the distribution line via branch lines. By the branch lines, filling members can easily be linked to the distribution line, whereby a modular, easily installable and easily adaptable arrangement of filling members is created. It should be pointed out that the distribution line, as represented in detail below, can be arranged for the provision and transport of the filling product or a component of this same, such as the base liquid or a dosage component. In particular, a plurality of distribution lines, which can transport different components of the filling product and, via appropriate branch lines, can feed these into the respective filling product lines can be provided. Of course, on the branch lines and/or at other suitable locations, valves can be installed in order to regulate, in particular to permit and shut off, the feed of the appropriate component(s) into the filling product line(s).

In various embodiments, the distribution line is a ring line, whereby the filling product or the appropriate component is transportable in a particularly reliable and uniform manner to the plurality of filling product lines. Moreover, such a topology is particularly suitable for the case of a rotary machine.

In some embodiments, the distribution line is fluidically connected via at least one supply line to a distributor, which is a fluid reservoir. The distributor can be a main reservoir or an intermediate reservoir, which, in turn, is fluidically connected, for example, to a main reservoir. The distributor is generally located above the filling members, whereby, in a structurally simple manner, a static pressure is provided for the feed-in of the appropriate component. In certain embodiments, one or more branch lines and/or one or more sections of the distribution line are fluidically connected via one or more supply lines to a distributor and draw the appropriate component from the distributor.

It should be pointed out that spatial specifications, such as "under", "below", "over", "above", etc., relate to the installation position of the apparatus, which is clearly defined by the bottling in the gravitational direction.

In several embodiments, the supply line, at least in some sections, is of flexible configuration. Alternatively or additionally, the distribution line generally, at least in some sections, is of flexible configuration. When, for the sake of linguistic simplicity, the supply line or the distribution line is herein used in the singular, the said design variants apply analogously to the case of a plurality of supply lines or distribution lines. The flexibility can be realized by a suitable choice of material, for example Teflon (polytetrafluoroethylene), and/or by mechanical structures, such as the use of one (or more) bellows, joint(s), rotary distributor(s), etc. It should be pointed out that the aforementioned Teflon is a general material for some or all fluid-carrying components, such as lines, valves, etc., since the transport behaviour of the fluids, due to the low surface energy, can be improved. Equally, Teflon has a very good resistance to any migration of aromatic substances.

In various embodiments, a base reservoir, which is fluidically connected to the filling product lines of the filling members and is arranged to provide a base liquid, is provided. In addition, the filling members typically respectively have one or more, for example two or more, dosage supply lines, for example dosage valves, which are respectively arranged to feed a dosage component from an appropriate dosage reservoir into the filling product line. A distribution line is herein fluidically connected to the base reservoir and is arranged to supply the filling product lines with the base liquid. Alternatively or additionally, at least one distribution line can be fluidically connected to one of the dosage reservoirs and is arranged to supply the filling product lines with the appropriate dosage component.

Virtually any chosen number of flavours can thus be bottled in a highly flexible manner, individually with respect to the specific container group. A changing of the base liquid, for example an adaptation of the water type, can be waived in the event of a change of variety, whereby any discharge quantities can be minimized. Thus, water of only one type (for example still) has to be provided, for instance, as the base liquid. Also a plurality of plants can be supplied with the same type of water, regardless of which variety is bottled therein. With regard to the blending, no container is present on the filling member during the dosing phase, since the dosing or blending does not take place in the bottling operation, but in the filling product line. The blending time can be used synergetically for the container transport. Thus, the concept which is represented herein is applicable both to linear transfer machines having one or more filling points and to rotary machines. In the case of rotary machines, the containers can leave the carousel again already after a small angle of rotation.

That section of the filling product line into which the dosage component(s) is/are fed is herein also referred to as the "dosing space". The one or more dosage valves are general versions of dosage supply lines. In other words: In specific embodiments in which the feed and any measuring-off of the dosage component(s) into the dosing space is realized by means external to the filling member, the dosage valves, where appropriate, can be dispensed with. Moreover, it should be pointed out that no substantial or even complete intermixing of the components has necessarily to take place in the dosing space. An actual intermixing can also take place during the bottling, or later in the container. Rather, the dosing space primarily serves to dose one or more dosage components into the main component.

In various embodiments, the dosage components are provided at a higher pressure than the base component, whereby the dosage components can be added in by rearward displacement of the base liquid.

In some embodiments, the apparatus has at least one flowmeter, which is disposed between the base reservoir and a filling member, typically between the base reservoir and the distribution line, and is arranged to determine the quantity of fluid passing through the flowmeter. To each filling member can be assigned a flowmeter. However, the present architecture allows that, for a group of filling members or all filling members, only one flowmeter is installed, whereby the structural complexity can be reduced further.

With the thus implemented "backflow measurement", i.e. the determination of that volume of the base liquid that is displaced by the fed-in dosage component rearwards out of the dosing space, the mix ratio can be determined in a mechanically simple, compact and reliable manner. During the dosing phase, no container has to be present at the filling member, since the dosing or blending is not conducted in the bottling operation but in the dosing space. The dosing time can be used synergetically for the container transport. The flowmeter is always flowed through, moreover, only by the base liquid, i.e. in most cases water. Thus the media properties do not change and the line system is in these regions not polluted by different fluids.

In certain embodiments, the apparatus is configured as a rotary machine having a carousel for the transport and filling of the containers by the filling members. A fluidic "serial connection" or "ring circuit" of a plurality of filling members is used particularly in a rotary machine, since the supply of fluid to the filling members can in this case be structurally integrated particularly easily in this way. Moreover, the time for blending any dosage components can be used synergetically for the container transport, so that the containers can leave the carousel already after a small angle of rotation.

In several embodiments, the filling members respectively have a gas line in order to evacuate to an underpressure $P_{low}$ the container to be filled, wherein the filling members are generally arranged to feed the filling product under an overpressure into the evacuated container.

The terms "underpressure" and "overpressure" should firstly be interpreted relative to one another. However, the underpressure $P_{low}$, after the evacuation, lies generally below the atmospheric pressure (=standard pressure). The overpressure of the filling product under which bottling is conducted can equate to the atmospheric pressure, yet typically lies above this.

Thus, the container, prior to the feed-in of the filling product, is generally evacuated to an underpressure $P_{low}$ with an absolute pressure of 0.5 to 0.05 bar, for example 0.3 to 0.1 bar, for example, 0.1 bar. In certain embodiments, the overpressure lies above the atmospheric pressure, for example with an absolute pressure of 1.1 bar to 6 bar. In this way, the container is evacuated such that, in the course of the filling with the filling product, substantially no gas is displaced by the filling product and accordingly also no gas has to flow out of the interior of the container. Rather, the entire mouth cross section of the container can be used for the feed-in of the filling product. In other words, in the filling operation, only a filling product stream directed into the container arises, yet no opposite fluid stream.

Besides the prompt bottling due to the pressure differential, virtually any number of flavours can thus be bottled in a highly flexible manner, individually with respect to the specific container group, without incidence of significant aroma entrainments or the like. For, as a result of the high pressure differential in the system during the bottling, the flushing-out of the filling member is optimized, whereby any product or aroma entrainments into follow-on containers are prevented or at least minimized. Since, moreover, during the filling, no return gas is to be drained from the container, via this path too no aroma can make its way into the system, in particular into a product vessel.

In various embodiments, for each filling member is provided a treatment chamber, into which the container to be filled can be at least partially introduced for the evacuation and filling and which can be sealed off from the external environment and possesses a gas supply which is arranged to generate an overpressure in the treatment chamber. In this way, a frothing-over after the filling operation, in particular after the removal of the filling member from the container mouth, is able to be avoided. In some embodiments, the overpressure in the treatment chamber equates to the overpressure with which the filling product is fed into the container. In the case of carbon-dioxide-containing products, the overpressure in the treatment chamber generally equates to the filling pressure or saturation pressure of the carbon dioxide, whereby a frothing-up or frothing-over of the filling product after completion of the filling process is effectively prevented. If the internal pressure of the treatment chamber is generated by carbon dioxide or a gas containing carbon dioxide, the filling product in the container, after the filling operation, can in this way, moreover, be charged with carbon dioxide. Through the choice of the overpressure in the treatment chamber, the $CO_2$ content in the filling product is thus able to be adjusted on a container-group-wise and variety-wise basis.

In certain embodiments, each filling member has a mouth section and is in this case arranged such that the mouth section, for the evacuation and filling of the container in the treatment chamber, can be brought sealingly into fluidic communication with the said container, wherein, to this end, the filling member is at least partially manoeuvrable. The manoeuvrability can here be viewed relative to the treatment chamber. The evacuation and filling of the container can thus be performed rapidly and reliably, and at the same time foreign particles are prevented from making their way into the inside of the container. For a reliable fitting of the mouth section on the container mouth, the mouth section can have a centring bell having a seal, for instance having a suitably shaped rubber contact seal.

In various embodiments, for each filling member is provided a closure member, which is arranged to receive a cap and, after the filling, to close the container in the appropriate treatment chamber with the cap. The closure is realized generally in the treatment chamber under the overpressure which has been built up therein. For this purpose, the closure member can have a capping head, which juts into the treatment chamber and is manoeuvrable in a substantially vertical direction. The transfer of a cap to the capping head can be realized in various ways. For instance, for each filling/closure cycle, a cap, for instance by a sorting mechanism and a feed chute, can in a first step be introduced into the treatment chamber and transferred to the capping head. As a result of the closure directly after the filling and under overpressure in the treatment chamber, the bottling process can be considerably accelerated, since substantially no settling phase of the filling product, even if it is carbonated, is necessary.

In certain embodiments, the apparatus has means for introducing carbon dioxide into the filling product lines and/or into the containers. Virtually any chosen carbonic acid content can thus be set on a container-wise (or container-group-wise) and variety-specific basis. Thus water, for instance, as a possible main component of just one type (for example still or, to a certain degree, carbonated). must be made available as the base liquid. Also a plurality of plants can be supplied with the same type of water, regardless of which varieties are bottled therein. In this context, an alignment to the filling product having the lowest carbonic acid content is not absolutely necessary. Moreover, still filling products too can be bottled in parallel with carbonated filling products.

In several embodiments, the apparatus is arranged to flush the containers with carbon dioxide, prior to the evacuation, by means of the filling members, for example via the gas lines thereof, and afterwards to evacuate the containers to a variable underpressure $P_{low}$, in order in this way to set the carbon dioxide content in the bottled filling product. In this way, the evacuation of the container, thus the prompt bottling, is synergetically combined with the individual carbonization of the filling product. The terms "evacuation", "evacuate" and the like thus do not herein necessarily imply the effort to approximate the underpressure in the container as far as possible to a perfect vacuum.

In certain embodiments, the filling apparatus is arranged to adapt the overpressure at which the filling product is fed into the container to the underpressure $P_{low}$, for example such that the pressure differential between the overpressure and the underpressure $P_{low}$ remains substantially constant. The variation of the underpressure $P_{low}$ thus does not necessarily affect the bottling speed, and thus the duration of the bottling process. The pressure differential can be chosen such that the container-wise, variety-specific carbonization leaves the control system of the filling process, in particular clock rate, cycle duration, etc., unaffected.

Further advantages and features of the present invention can be seen from the following description of the illustrative embodiments. The features which are there described can be implemented in isolation or in combination with one or more of the above-presented features, insofar as the features are not mutually contradictory. The following description of illustrative embodiments is here made with reference to the accompanying drawings.

BRIEF DESCRIPTION OF THE FIGURES

Further embodiments of the invention are explained in greater detail by the following description of the figures.

DETAILED DESCRIPTION

Below, illustrative embodiments are described with reference to the figures. Same, similar or like-acting elements in the figures are here provided with identical reference symbols and a repeated description of these elements is partially dispensed with in order to avoid redundancies.

Figure 1:
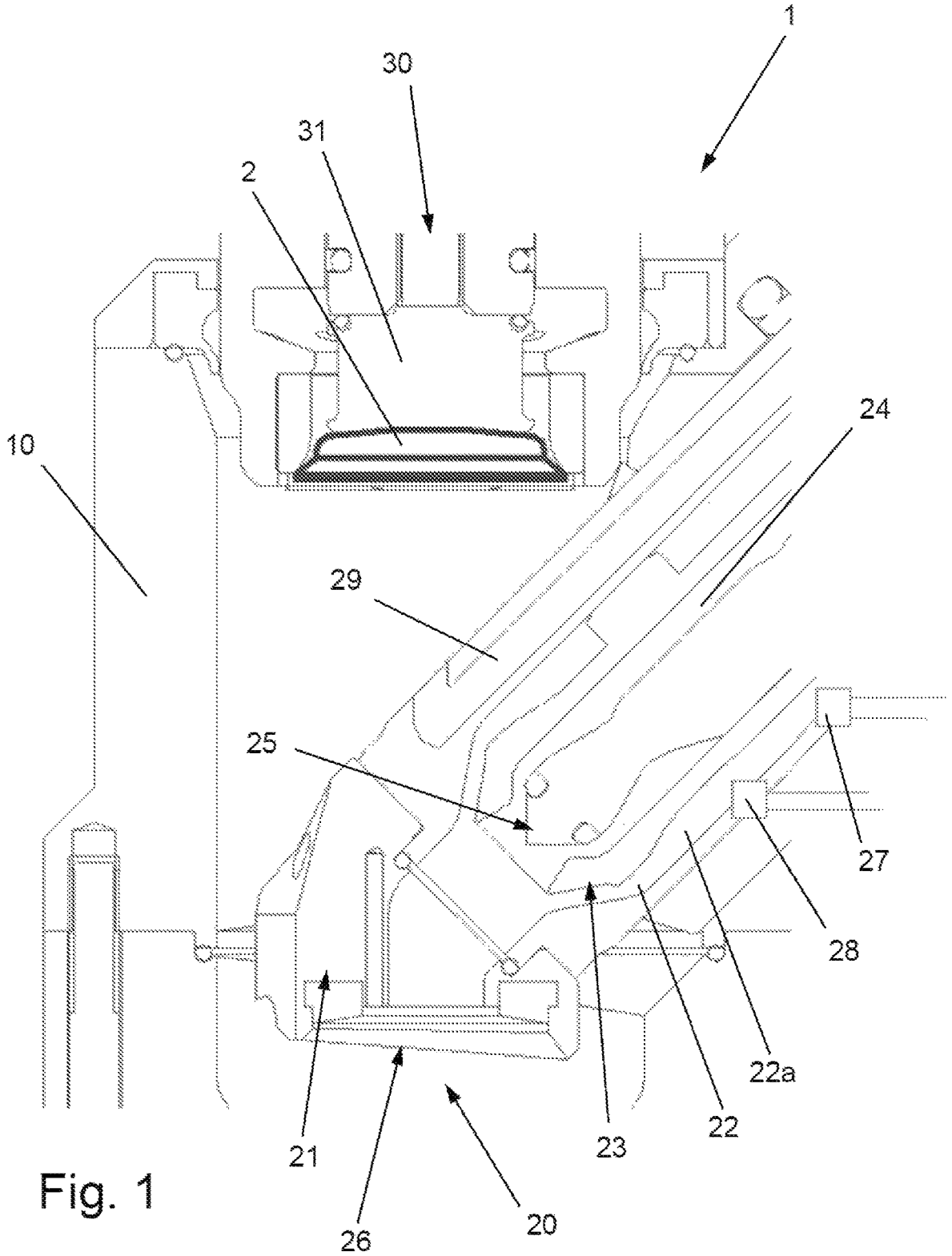
FIG. 1 shows a schematic cross-sectional view, viewed from the side, which shows a detail of a filling apparatus.

FIG. 1 shows a detail of a filling apparatus 1 for filling a container (not shown in FIG. 1) with a filling product and for closing the container with a cap 2 in a beverage bottling plant.

The filling apparatus 1 has a filling member 20, which, in the process stage shown in FIG. 1, juts into a treatment chamber 10. The filling member 20 has accommodated in a filling member housing 21; a filling product line 22; a filling valve 23, which is disposed at the lower, i.e. downstream-situated end, of the filling product line 22; a gas line 24; and a gas valve 25, which is disposed at the lower end of the gas line 24.

Via the gas line 24 and the gas valve 25, the container can be flushed and/or pretensioned with a gas, for example inert gas, nitrogen and/or carbon dioxide. In addition, the interior of the container can via thereby be set, for example evacuated, to a desired pressure. It should be pointed out that the gas line 24 can be a multi-channel construction, for instance, by virtue of a pipe-in-pipe construction, can include a plurality of gas lines in order, where necessary, to physically separate the supply of one or more gases into the container and/or the drainage of gas from the container.

The gas valve 25 includes, for instance, a gas valve cone and a gas valve seat, which are arranged to regulate the gas flow. For this purpose, the gas valve cone is switchable via an actuator (not represented).

The filling product line 22 is generally designed as a ring line, which extends substantially concentrically to the gas line 24. The filling valve 23 includes, for instance, a filling valve cone and a filling valve seat, which are arranged to regulate the flow of the filling product. The filling valve 23 is arranged to enable a complete shut-off of the filling product stream. In the simplest case, the filling valve 23 has two settings, an open and a fully closed setting. For this purpose, the filling valve 23 is switchable via an actuator (not represented).

The actuation of the gas valve 25 and that of the filling valve 23 take place via actuators (not expounded in detail). It should be pointed out that the gas valve 25 and the filling valve 23 can be operatively connected to one another, so that, for instance, an actuator can be arranged for joint usage in order to simplify the structure of the filling member 20 and increase reliability.

The filling member 20 has at the exit end of the media a mouth section 26, which is arranged such that the container mouth can be brought sealingly against the mouth section 26. For this purpose, the mouth section 26 generally has a centring bell having a suitably shaped rubber contact seal. The filling member 20 having the mouth section 26 is arranged for a so-called wall filling, in which the filling product, after exit from the mouth section 26, flows downwards on the container wall. In certain embodiments, the filling product line 22 and the mouth section 26 are of such a nature, or have appropriate means such that the filling product, in the bottling operation, is set spinning, whereby the filling product is propelled outwards due to centrifugal force and, after exit from the mouth section 26, flows downwards in a spiral motion In order to realize a rapid change of variety, substantially without changeover time, the filling member 20 has one or more, for example at least two, dosage valves 27, 28, which open into a dosing space 22*a*. As a result, the product to be bottled can be changed over in rounds, i.e. in one round the filling member 20 fills orangeade, for instance, in the next round lemonade, for instance, Moreover, through the provision of a plurality of dosage valves 27, 28, a dosage string can be flushed with water, for example, and cleaned, whilst another dosage string is used for the bottling. In this way, the bottling process and any cleaning of parts of the machine are combined synergetically by simultaneous or temporally overlapping execution, whereby productivity can be boosted.

The dosage valves 27, 28 are generally versions or embodiments of dosage supply lines. In other words: In certain embodiments in which the feed and any measuring-out of the dosage component(s) into the dosing space 22*a* is realized by means external to the filling member 20, the dosage valves 27, 28, where appropriate, can be dispensed with, so that, for instance, only appropriate dosage lines or dosage ducts open into the dosing space 22*a*.

The dosing space 22*a* can be a section or suitably shaped part of the filling product line 22. Via the dosage valves 27, 28, to which appropriate dosage lines are linked, one or more dosage components, for instance syrup, pulp, aromas etc., are added to a main component, for instance water or beer, which has been fed via the filling product line 22 into the dosing space 22*a*. The way in which the measuring-out can take place in the metered feed-in of the dosage components is explained further below with reference to FIG. 2.

The filling member 20 is arranged to be at least partially manoeuvrable, so that that arm-like section of the filling member 20 that is shown in FIG. 1 is retracted into the treatment chamber 10 and either withdrawn therein or partially, or even fully, removed therefrom. It is thereby possible to press the container mouth, for the bottling operation, against the mouth section 26 of the filling member 20 and subsequently, after completion of the bottling process, to withdraw the filling member 20 to the extent that the container, in the treatment chamber 10, can be closed.

In order to ensure the manoeuvrability of the filling member 20 without the atmosphere of the treatment chamber 10 being exposed to uncontrolled external influences, sealing means (not represented in FIG. 1) are accordingly provided. For instance, the treatment chamber pressure, after completion of the bottling operation, can be greater than the pressure of the external environment, which in this case does not necessarily have to be the atmospheric pressure, whereby a penetration of impurities into the treatment chamber 10 can be virtually precluded. Alternatively or additionally, the treatment chamber 10 can be located in a clean room or can form one such.

In the present illustrative embodiment, the filling apparatus 1 further has a closure member 30 for closing the container. The closure member 30 has a capping head 31, which juts into the treatment chamber 10 and, in the present illustrative embodiment, is manoeuvrable in the substantially vertical direction. Like the filling member 20, the closure member 30 is sealed off from the walling of the treatment chamber 10 in order to avoid a contamination or uncontrolled impairment of the atmosphere inside the treatment chamber 10 by external influences.

The closure member 30 is configured and arranged to receive and hold a cap 2 on the capping head 31. For this purpose, the capping head 31 can have a magnet, whereby, in a structurally simple manner, a cap 2, in particular if this is a metallic crown cap, can be received in centred arrangement and, for the closure of the container, lowered onto the container mouth. Alternatively, the cap 2 can be grasped by suitable gripping or clamping means, held, and applied to the container mouth, so that the concept which is presented herein is also applicable to plastics closures, screw caps etc.

The capping head 31 is arranged to be manoeuvrable in the up and down direction, wherein it is disposed substantially coaxially to the container mouth in order to be able to apply the cap 2 reliably to the container.

The transfer of a cap 2 to the capping head 31 can be realized in various ways. For instance, for each filling/closure cycle, a cap 2 can in a first step be introduced by a sorting mechanism and a feed chute into the treatment chamber 10. For this purpose, the treatment chamber 10 can be part of the closure member 30 and execute a relative movement to the closure feed, for example the feed chute or a transfer arm, wherein the capping head 31 picks a cap 2 from the closure feed and holds it.

It should be pointed out that the closure of the container can also be realized elsewhere. In particular in the case of carbon-dioxide-containing filling products, the closure typically takes place, however, directly after the filling and in the treatment chamber 10 under overpressure, as explained below.

For the filling of the container this is raised, the container mouth is introduced into the treatment chamber 10 and is sealed off from the treatment chamber 10. The container mouth is pressed sealingly against the mouth section 26 of the filling member 20 extended in the filling position. The mouth section 26 of the filling member 20 thus marks the end position of the container stroke. The capping head 31 receives the cap 2 and retracts into the treatment chamber 10. The sealing of the treatment chamber 10 against the environment and against the container or its mouth region can be realized by the inflation of one or more seals. The treatment chamber 10 itself typically executes no lifting motion.

During the filling operation, a supply of gas into the treatment chamber 10 generally takes place. By such a parallel execution, the total process is able to be optimized. During the filling process, the treatment chamber 10 is sealed off to all sides, whereby a suitable internal pressure is built up in the treatment chamber 10. In the case of carbon-dioxide-containing filling products, this internal pressure generally equates to the filling pressure or saturation pressure of the carbon dioxide, whereby a frothing-up or frothing-over of the filling product after completion of the filling process is effectively prevented.

The gas supply can be realized by means of a valve (not represented in FIG. 1) in the walling of the treatment chamber 10. Alternatively or additionally, the gas supply can be at least partially integrated in the filling member 20. Thus the filling member 20 according to the present illustrative embodiment has, for this purpose, a treatment chamber gas line 29. The treatment chamber gas line 29, in particular its outlet into the treatment chamber 10, can be arranged such that the exiting gas jet strikes the bottom side of the cap 2 when the filling member 20 is in the filling position. In this way, a cleaning of the cap 2 at the same time takes place during the filling operation. As the gas, carbon dioxide is generally used, yet a different medium, such as sterile air, can also be used.

If the container is now filled and the interior of the treatment chamber 10 is brought to the desired pressure, the filling member 20 is withdrawn, and the capping head 31 continues its downward motion until, when it reaches the container mouth, the latter is closed.

A general process for the prompt filling and closure of the container with a filling product can be performed as follows:

a) evacuation of the container to an underpressure $P_{low}$;

b) filling of the filling product into the container, typically under an overpressure;

c) generation of an overpressure $P_{high}$ in the treatment chamber 10 and, if needed, in the head space of the container, in order to avoid a frothing-up and frothing-over of the filling product, when the filling member 20 is released from the container mouth;

d) application of the cap 2 to the container mouth and closure of the container, without prior decompression to environmental pressure;

e) deaeration of the treatment chamber 10 and extraction of the container for further processing (for instance labelling, packaging, etc.).

The terms "underpressure" and "overpressure" should firstly be interpreted relative to one another. However, the underpressure $P_{low}$ after the evacuation in step a) lies generally below the atmospheric pressure (=standard pressure). The overpressure $P_{high}$ generated in step c) can equate to the atmospheric pressure, yet generally lies above this.

Thus, the container, prior to the feed-in of the filling product, is typically evacuated to an underpressure $P_{low}$ with an absolute pressure of 0.5 to 0.05 bar, for example 0.3 to 0.1 bar, for example, 0.1 bar. In certain embodiments, the overpressure $P_{high}$ lies above the atmospheric pressures, for example at an absolute pressure of 1.1 bar to 6 bar. In this way, the container is evacuated such that, in the filling with the filling product, substantially no gas is displaced by the filling product and, accordingly, no gas has to flow out of the interior of the container. Rather, the total mouth cross section of the container can be used for the feed-in of the filling product. In other words, in the filling operation, only a filling product stream directed into the container arises, yet no opposite fluid stream.

Figure 2:
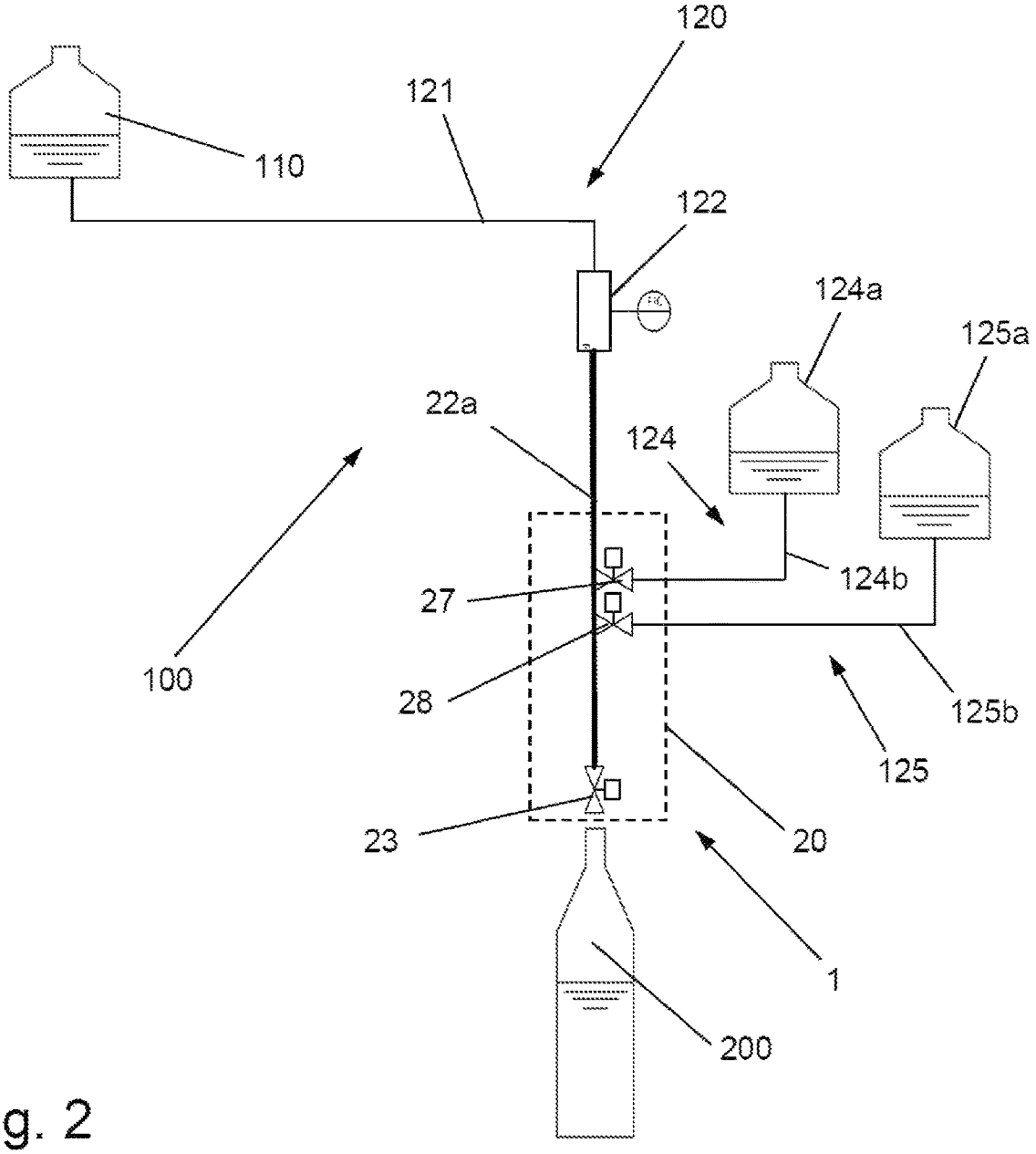
FIG. 2 shows a schematic representation of an apparatus for filling a container with a multicomponent filling product.

FIG. 2 is a schematic representation of an apparatus 100 for filling a container 200 with a multicomponent filling product.

The apparatus 100 has a base reservoir 110 for a base liquid, which can also be regarded as the main product, and a filling apparatus 1 with filling member 20 according to the preceding description. The filling apparatus 1 is shown in FIG. 2, for the sake of clarity, only schematically, in particular without treatment chamber 10 and without closure member 30.

The base liquid and any dosage components which can be admixed via a below-described fluid system are fed via the filling member 20 into the container 200. The base liquid is, for instance, water or beer. The dosage components can include, for instance, syrup, fruit-flesh-containing liquids, pulp, aromas etc.

The apparatus 100 has a base line 120, which is arranged to feed the base liquid into the filling member 20 and into which the dosage components can be fed. Further lines (not presented herein), also referred to as "secondary lines", can be provided in order to mix in different quantities and/or further dosage components.

For this purpose, the base line 120 has a base conduit 121, which extends from the base reservoir 110 to the filling member 20. The base conduit 121 is equipped with a flowmeter 122. The flowmeter 122 is generally a contactless, for example an inductive, measuring device for determining the liquid flow, volume flow, passing through the flowmeter 122, of the transported mass or the like.

That section of the base conduit 121 which is located between the flowmeter 122 and the filling valve 23 shall be referred to as the dosing space 22*a* or contains one such. The dosing space 22*a* is arranged to measure off by rearward displacement, as described below, the dosage components which are to be fed in.

According to the present illustrative embodiment, two dosage branches 124, 125 open into the dosing space 22*a*. The two dosage branches 124, 125 respectively have a dosage reservoir 124*a*, 125*a*, a dosage line 124*b*, 125*b* fluidically connected thereto, and a dosage valve 27, 28, which brings the associated dosage line 124*b*, 125*b* switchably into fluidic connection with the dosing space 22*a*.

With the provision of a plurality of dosage branches 124, 125, the product to be bottled can be changed over in rounds, i.e. in one round the filling member 20 fills orangeade, for instance, in the next round lemonade, for instance. Moreover, a dosage branch 124, 125 can be flushed with water, for example, and cleaned, whilst another dosage branch 124, 125 is used for the bottling. In this way, the bottling process and any cleaning of parts of the machine can be combined synergetically or performed simultaneously, whereby productivity can be boosted.

With the selection of the nominal widths of the dosing space 22*a*, of the flowmeter 122 and/or of the dosage branches 124, 125, a dosing range for the base line 120 is fixed.

Below, the dosage and bottling process is described by reference to the apparatus 100 according to the illustrative embodiment of FIG. 2:

At the beginning of each fill cycle, the base line 120 is flushed with the base liquid, whereby the associated dosing space 22*a*, with the filling member 20 closed, is filled with the base liquid. In the filling of the dosing space, the associated flowmeter 122 can measure the flow of base liquid in the forward direction, i.e. the filling direction. In this way, the desired total fill volume of the dosing space 22*a* is able to be determined and adjusted.

Subsequently the dosage components are fed into the dosing space 22*a* by opening of the appropriate dosage valves 27, 28. The dosage components can be fed in simultaneously or one after another. The feed-in of the dosage components leads to a part of the base liquid being displaced rearwards out of the dosing space 22*a*. The rearwardly directed flow is herein detected by the flowmeter 122. The dosage valves 27, 28, which can be designed as pure shut-off valves or else as controllable shut-off valves, remain open until such time as the desired volume of the dosage component(s) is filled into the dosing space 22*a*. For this purpose, the flowmeter 122 and the valves of the apparatus 100 are communicatingly connected to a control device (not represented in the figures), which, on the basis of the detection findings of the flowmeter 122, determines the time of the opening/closing, or, in general, the switching behaviour of the components involved. It should be pointed out that the quantity of each individual dosage component can be accurately determined with just one flowmeter 122, in that different dosage components of a line are fed in one after another.

In the subsequent bottling phase, represented in the above with reference to FIG. 1, the dosing space 22*a* into the container 200 is emptied, whereby the line is fully flushed.

The reservoirs 110, 124*a*, 125*a* for the base liquid and the dosage components can respectively be subjected separately or jointly to a gas pressure in the head space in order to ensure the necessary pressure differential for the conveyance of the appropriate fluids. Alternatively or additionally, the static heights of the reservoirs 110, 124*a*, 125*a* can be chosen such that the pressure differentials enable the dosage components to be fed into the base liquid.

By virtue of the thus conducted feed-in and measuring-off of the dosage component(s) by rearward displacement, an accurate dosing is able to be obtained. As a result of the prompt bottling due to the pressure differential between the container 200 under underpressure and the filling product under overpressure, not only is the filling operation accelerated, but an optimal flushing-out of the filling member 20 is thus obtained, whereby an entrainment of aromas or filling product residues is effectively prevented.

Moreover, the herein presented technology for the container-wise and variety-wise rapid and reliable filling of containers 200 allows the filling product to be individually charged with carbonic acid. The carbonic acid content can be adjusted in various ways:

According to an illustrative embodiment, the desired carbonic acid content is defined by the $CO_2$ content in the container 200 prior to the bottling. This is possible, since the container 200, prior to the filling, is brought to the underpressure $P_{low}$. If the container 200, prior to the evacuation, is flushed with $CO_2$, then, by adjustment of $P_{low}$, the carbonic acid content can be set individually, in particular on a variety-specific and container-wise basis. In order to prevent a variation of the underpressure $P_{low}$ from affecting the duration of the bottling process, the overpressure at which the filling product is fed into the container 200 can be adapted accordingly. In various embodiments, the overpressure is chosen such that the pressure differential between this and $P_{low}$ remains roughly constant for different $P_{low}$ which determine the $CO_2$-content.

The carbonic acid content can alternatively or additionally be adjusted by direct feeding of $CO_2$ into the dosing space 22*a* and/or into the container 200 during the filling or at the end of the filling operation into the head space of the container 200. For this purpose, the gas line 24 and the gas valve 25, a dosage valve 27, 28, or another device of the filling member 20, can be arranged to conduct the $CO_2$ out of a $CO_2$-source into the filling product. Alternatively or additionally, the base liquid and/or one or more of the dosage components can be charged with $CO_2$, so that the variety-specific mixing of the components leads equally to a variety-specific $CO_2$-content.

If the internal pressure of the treatment chamber 10 is generated by carbon dioxide or a gas containing carbon dioxide, the filling product in the container can also in this way, after the filling, be charged with carbon dioxide. Through the choice of overpressure in the treatment chamber 10, the $CO_2$-content in the filling product container is this able to be set on a container-wise and variety-wise basis.

Thus virtually any chosen carbonic acid content can be set individually, in particular on a variety-specific and/or container-wise basis. At the same time, various filling products with various carbonic acid contents can be bottled. Virtually any chosen number of flavours can be bottled in a highly flexible manner on a container-specific basis, without incidence of significant aroma entrainments or the like. A modification of the base liquid, for example an adaptation of the water type, can be waived upon a change of variety, whereby any discharge quantities can be minimized. Thus, water of just one type (for example still or carbonated) must be provided as the base liquid. Also a plurality of plants can be supplied with the same type of water, regardless of which varieties are bottled therein. In this case, an alignment to the filling product having the lowest carbonic acid content is not absolutely necessary. Moreover, still filling products too can be bottled in parallel with carbonated filling products. By virtue of the high pressure differential in the system during the bottling, the flushing-out of the filling member 20 is optimized, whereby any product or aroma entrainments in following containers are prevented, or at least minimized. Since, moreover, no return gas has to be drained off from the container 200 during the filling operation, no aroma can make its way into the system, in particular the product vessel, via this route also.

With regard to the dosing, during the dosing phase no container 200 must bear against the filling member 20, since the dosing or blending is not conducted during the bottling, but in the dosing space 22*a*. The dosing time can be used synergetically for the container transport. The herein represented concept is hence applicable both to linear transfer machines having one or filling points and to rotary machines. In the case of rotary machines, the containers 200 cannot leave the carousel again already after a small angle of rotation.

The flowmeter 122 is constantly flowed through by the base liquid, i.e. in most cases by water. Hence the characteristics of the medium do not change and the line system is in these regions not contaminated by different fluids.

The mechanical complexity for the realization of the apparatus 100 is justifiable, since the line system can be realized by pipes or hose lines having few valves and only a single flowmeter (per line). No complicated geometries have to be built in, whereby the apparatus 100 is easy to clean and to maintain. The risk of blockage is low. Moreover, the apparatus 100 is suitable for the dosing of highly viscous fluids.

Figure 3:
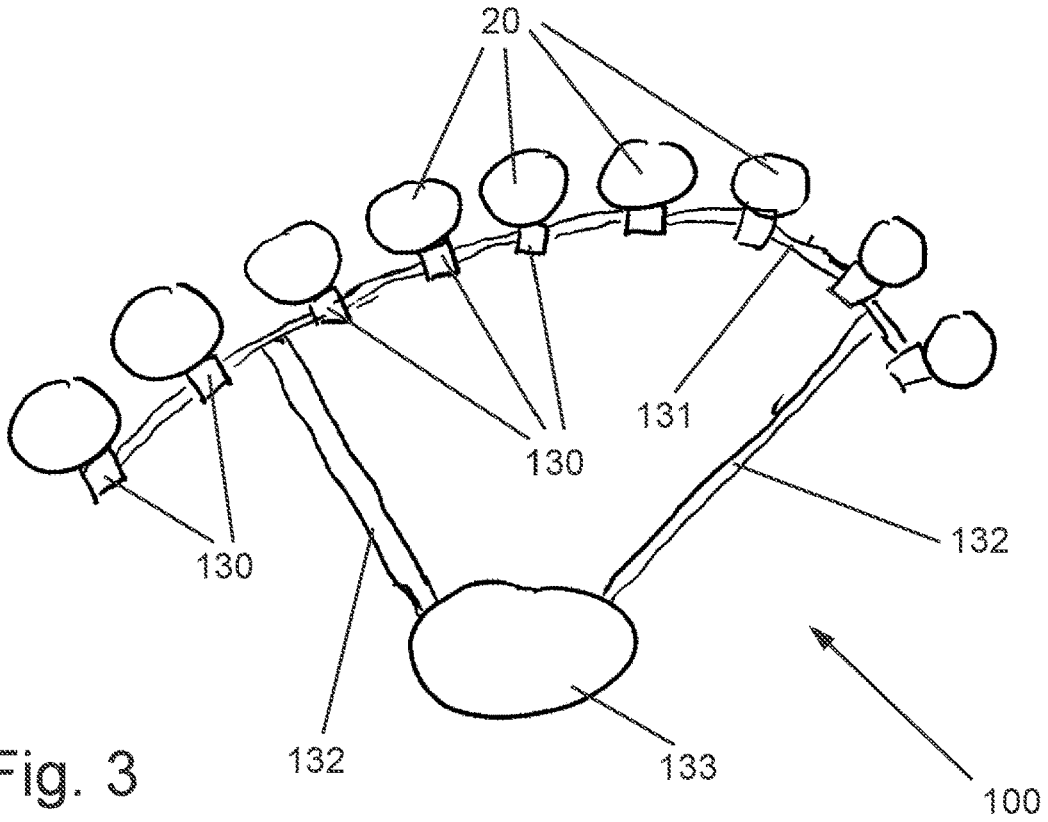
FIG. 3 shows a schematic top view of an arrangement of a plurality of filling members in a rotary machine.
Figure 4:
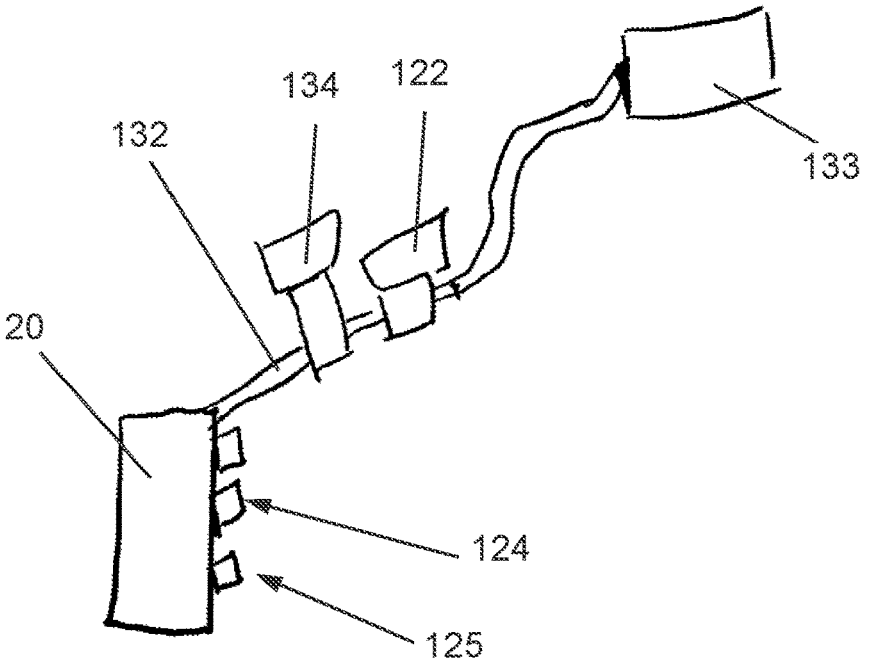
FIG. 4 shows a schematic side view of a filling member linked to a distributor.

Although the illustrative embodiments of FIGS. 1 and 2 relate to a filling apparatus 1 and an apparatus 100 for the prompt filling and closure of containers, an evacuation of the container prior to the feed-in of the filling product, the provision of a treatment chamber 10, of a closure member 30 and/or of other components can, where appropriate, be dispensed with, insofar as these are dispensable for the linkage of a plurality of filling members 20, which linkage is described below with reference to FIGS. 3 and 4.

In order, in the case of a plurality of filling members 20, to avoid an individual linkage of the filling members 20 to a dedicated base reservoir 110 and/or to dedicated dosage reservoirs 124*a*, 125*a*, plurality of filling members 20 can be connected to one another in series, as is evident from the schematic top view of FIG. 3.

For this purpose, the filling product lines 22, or their dosing spaces 22*a*, of the filling members 20 are fluidically connected via respective branch lines 130 to one or more distribution lines 131, which are generally realized as ring lines. In other words, the filling product lines 22 of the filling members 20 are not connected individually to one or more reservoirs, but via one more common distribution lines 131, from which they branch off. The branch lines 130 can also be realized such that sections of the distribution line 131 are linked directly to the filling product lines 22. Thus the filling product line 22 of a filling member 20 is initially fluidically connected, for instance, to the filling product line 22 of an adjacent filling member 20, the latter, in turn, being fluidically connected to the filling product line 22 of the second neighbour, etc.

One or more branch lines 130 and/or one or more sections of the distribution line(s) are fluidically connected via supply lines 132 to a distributor 133 and draw the appropriate component from the distributor 133. Such a "serial connection" or "ring circuit" of a plurality of filling members 20 is employed, for example, in a rotary machine having a carousel for the transport and treatment of the containers 200.

If the base liquid is provided via a distribution line 131, then the filling product lines 22, base conduits 121 or dosing spaces 22*a* branch off from the distribution line 131. The distribution line 131 shall in this case be referred to as the "base liquid-distribution line". The distribution line 131 is, in turn, fluidically connected via one or more supply lines 132 to a distributor 133. The distributor 133 shall in this case be referred to as the "base liquid distributor". The base liquid distributor can be the base reservoir 110 or an intermediate reservoir, for example a vessel, fluidically connected thereto. In various embodiments, the base liquid distributor 133 is disposed above the filling members 20, as is shown schematically in FIG. 4.

FIG. 4 further shows the flowmeter 122 and a shut-off valve 134 in the supply line 132 in order to illustrate that, in the case of such a "serial connection" of a plurality of filling members 20, a flowmeter 122 does not necessarily have to be assigned and installed for each filling member 20. In this way, the structural complexity of the apparatus 100 can be further reduced.

Alternatively or additionally, one or more of the dosage components can be provided via respectively a common distribution line 131, wherein, in this case, the appropriate dosage lines 124*b*, 125*b* or dosage valves 27, 28 branch off from the distribution line 131. The distribution line 131 shall in this case be referred to as the "dosage component distribution line". In this case too, the distribution line 131 is, in turn, fluidically connected via one or more supply lines 132 to a distributor 133. The distributor 133 shall in this case be referred to as a "dosage component distributor". The dosage component distributor can be a dosage reservoir 124*a*, 125*b*, or an intermediate reservoir, for example a vessel, fluidically connected thereto. In some embodiments, the dosage component distributor is disposed above the filling members 20.

The feeding of the dosage component(s) into the dosing space 22*a* is generally realized at a higher pressure than the feeding of the base liquid, in order thus to enable, or at least to facilitate, the previously described dosing by rearward displacement. For this purpose, the dosage component distributor has, for example, due to its static height and/or a higher pressure, a higher pressure level than the base reservoir 110 or the base liquid distributor.

The distribution line 131 can consist of a plurality of sections linked to the branch lines 130 or the filling product lines 22. It can be of rigid configuration; in certain embodiments, it is however, at least in some sections, flexible, in order to enable, or at least to simplify, a manoeuvrability of the filling members 20. An, at least in some sections, flexible configuration of the distribution line 131 is particularly of advantage when the filling members 20 are designed for a lifting motion in order to move from above onto the container 200. The flexibility can be realized by a suitable choice of material, for example Teflon, and/or by mechanical structures, such as the use of one (or more) bellows, joints, rotary distributors, etc.

Equally, the supply lines 132 are generally, at least in some sections, of flexible configuration, in order to enable, or at least to simplify, any manoeuvrability of the filling members 20, in particular a lifting motion. The flexibility can be realized by a suitable choice of material, generally Teflon, and/or by mechanical structures, such as the use of one (or more) bellow, joints, rotary distributors, etc.

It should be pointed out that the aforementioned Teflon is a typical material for some or all fluid-carrying components, such as lines, valves, etc., since the transport behaviour of the fluids is improved due to the low surface energy. Equally, Teflon has very good resistance to any migration of aromatic substances.

The previously described "serial connection", which includes the general "ring circuit", provides a mechanically simple, reliable and low-maintenance realization of the apparatus 100, wherein the containers 200, furthermore, can be bottled virtually individually, in particular on a variety-specific and/or container-group-wise basis. The handling of the individual filling members 20 is facilitated, in particular if the distribution line(s) 131 and/or supply line(s) 132, at least in some sections, are of flexible configuration.

Where applicable, all individual features which are represented in the illustrative embodiments can be mutually combined and/or exchanged, without departing from the scope of the invention.

The invention claimed is:

1. An apparatus for filling containers with a filling product comprising:

a plurality of filling members, wherein each filling member of the plurality of filling members comprises a filling product line configured to feed the filling product into a container;

a distribution line, wherein each filling product line of the plurality of filling members is linked to the distribution line;

a supply line;

a fluid reservoir; and a base reservoir fluidically connected to each filling product line of the plurality of filling members and configured to provide a base liquid, wherein:

the distribution line is fluidically connected via the supply line to the fluid reservoir;

the plurality of filling members each further comprise a dosage supply line that is configured to feed a dosage component from a dosage reservoir into a respective filling product line, the distribution line is fluidically connected to the base reservoir and is configured to supply each filling product line of the plurality of filling members with the base liquid, or the distribution line is fluidically connected to the dosage reservoir and is configured to supply each filling product line of the plurality of filling members with the dosage component, and the dosage component is provided at a higher pressure than the base liquid and is configured to be fed into each filling product line of the plurality of filling members such that the base liquid is displaced rearwardly.

2. The apparatus of claim 1, further comprising a plurality of branch lines, wherein each filling product line of the plurality of filling members branches off from the distribution line via a branch line of the plurality of branch lines.

3. The apparatus of claim 1, wherein the distribution line comprises a ring line.

4. The apparatus of claim 1, wherein the fluid reservoir is disposed above the plurality of filling members.

5. The apparatus of claim 1, wherein the supply line or the distribution line comprises a flexible material.

6. The apparatus of claim 5, wherein the flexible material comprises polytetrafluoroethylene.

7. The apparatus of claim 1, wherein the supply line or the distribution line comprises a bellows, a joint, or a rotary distributor.

8. The apparatus of claim 1, further comprising a flowmeter that is disposed between the base reservoir and a filling member, wherein the flowmeter is configured to determine a quantity of fluid passing through the flowmeter.

9. The apparatus of claim 1, wherein the apparatus is configured as a rotary machine having a carousel configured to transport and to fill the containers by the plurality of filling members.

10. The apparatus of claim 1, wherein each of the plurality of filling members comprises a gas line configured to evacuate a container to an underpressure and each of the plurality of filling members are configured to feed the filling product under an overpressure into an evacuated container.

11. The apparatus of claim 10, further comprising a plurality of treatment chambers configured to hold the container during evacuation and filling, wherein each treatment chamber is operationally associated with a filling member, is configured to seal the container off from an external environment, and comprises a gas supply that is configured to generate an overpressure in the treatment chamber.

12. The apparatus of claim 11, wherein each of the plurality of filling members comprises a mouth section, is configured such that the mouth section can be brought sealingly into fluidic communication with the container during the evacuation and the filling of the container in a treatment chamber from the plurality of treatment chambers, and is at least partially maneuverable.

13. The apparatus of claim 11, wherein each of the plurality of filling members comprises a closure member configured to receive a cap, and after the filling of the container, to close the container in a treatment chamber from the plurality of treatment chambers with the cap.

14. The apparatus of claim 11, further comprising means for introducing carbon dioxide into each filling product line of the plurality of filling members and/or into the container.

15. The apparatus of claim 14, wherein each of the plurality of filling members is configured to flush the container with the carbon dioxide via a gas line prior to the evacuation, and after flushing the container, to evacuate the container to a variable underpressure.

16. An apparatus for filling containers with a filling product comprising:

a plurality of filling members, each filling member of the plurality of filling members having a filling product line configured to feed the filling product into a container;

a plurality of distribution lines, wherein each distribution line of the plurality of distribution lines is linked to a filling product line and is configured to transport a base liquid or a dosage component of the filling product;

a plurality of branch lines, wherein each filling product line branches off from a distribution line via a branch line of the plurality of branch lines;

a plurality of supply lines;

a fluid reservoir; and a base reservoir fluidically connected to each filling product line of the plurality of filling members and configured to provide a base liquid, wherein:

each distribution line of the plurality of distribution lines is fluidically connected via a supply line from the plurality of supply lines to the fluid reservoir, the plurality of filling members each further comprise a dosage supply line that is configured to feed a dosage component from a dosage reservoir into a respective filling product line, a distribution line is fluidically connected to the base reservoir and is configured to supply each filling product line of the plurality of filling members with the base liquid, or a distribution line is fluidically connected to the dosage reservoir and is configured to supply each filling product line of the plurality of filling members with the dosage component, and the dosage component is provided at a higher pressure than the base liquid and is configured to be fed into each filling product line of the plurality of filling members such that the base liquid is displaced rearwardly.

17. The apparatus of claim 16, wherein the apparatus is configured as a rotary machine having a carousel configured to transport and to fill the containers by the plurality of filling members.

18. The apparatus of claim 16, wherein each of the plurality of filling members comprises a gas line configured to evacuate a container to an underpressure and each of the plurality of filling members is configured to feed the filling product under an overpressure into an evacuated container.

19. The apparatus of claim 16, wherein a supply line or a distribution line comprises a flexible material.

20. The apparatus of claim 19, wherein the flexible material comprises polytetrafluoroethylene.

* * * * *